United States Patent [19]

Jacobs

[11] Patent Number: 4,645,251

[45] Date of Patent: Feb. 24, 1987

[54] GLOVE-LIKE WASTE DISPOSAL SYSTEM

[75] Inventor: Alvin D. Jacobs, New York, N.Y.

[73] Assignee: Leonard Holtz, Oceanside, N.Y. ; a part interest

[21] Appl. No.: 812,303

[22] Filed: Dec. 23, 1985

[51] Int. Cl.[4] ..... A01K 29/00; A41D 19/00

[52] U.S. Cl. ..... 294/1.3; 2/20; 2/164; 15/227

[58] Field of Search ..... 294/1.3, 25; 2/16, 20, 2/158-160, 161 R, 164, 167, 168; 15/104.8, 227, 257.1; 206/223, 204, 438, 496

[56] References Cited

U.S. PATENT DOCUMENTS

| | | | |
|---|---|---|---|
| 2,446,921 | 8/1948 | Grant | 2/168 |
| 2,736,052 | 2/1956 | Tufarolo | 15/227 |
| 2,763,864 | 9/1956 | Conrad | 2/20 |
| 2,880,436 | 4/1959 | Hayden | 15/227 X |
| 2,976,540 | 3/1961 | Sutherland . | |
| 3,103,029 | 9/1963 | Valles | 15/227 |
| 3,110,035 | 11/1963 | LaHue | 2/168 |
| 3,191,187 | 6/1965 | Comer et al. . | |
| 3,850,467 | 11/1974 | Johnson . | |
| 3,866,245 | 2/1975 | Sutherland . | |
| 4,065,826 | 1/1978 | Hough | 15/227 |
| 4,103,952 | 8/1978 | Thompson . | |
| 4,185,330 | 1/1980 | Stager . | |
| 4,186,955 | 2/1980 | Campbell . | |
| 4,205,869 | 6/1980 | Mathis . | |
| 4,230,354 | 10/1980 | Claras . | |
| 4,252,356 | 2/1981 | Tokuzumi . | |
| 4,347,931 | 9/1982 | Ginger et al. | 15/227 X |
| 4,454,611 | 6/1984 | Tschirch et al. | 2/164 X |

FOREIGN PATENT DOCUMENTS

| | | | |
|---|---|---|---|
| 2530940 | 2/1984 | France | 15/227 |
| 1394669 | 5/1975 | United Kingdom | 15/227 |
| 2100581 | 1/1983 | United Kingdom . | |

*Primary Examiner*—Johnny D. Cherry

*Attorney, Agent, or Firm*—Frishauf, Holtz, Goodman & Woodward

[57] ABSTRACT

A glove-like waste disposal system comprises a relatively thick, heat-insulating, flexible inner glove which is placed over the hand of a user. An outer glove is then placed over the inner glove, the outer glove being made of a thin, flexible, disposable material. In use, the waste material is picked up by the user whose hand is contained within the inner glove, the outer glove is peeled or stripped off to an inside-out pouch-forming configuration which contains the picked-up waste material therein, and the outer glove with the waste material therein is disposed. The inner glove is reusable, and serves to insulate the user's hand from the temperature and "feel" of the waste material. Absorbant layers may be attached to the inner (palm) or outer (back of hand) side of the outer flexible disposable glove to absorb moisture.

19 Claims, 6 Drawing Figures

GLOVE-LIKE WASTE DISPOSAL SYSTEM

BACKGROUND OF THE INVENTION

This invention relates to a waste disposal system for disposing of waste, especially animal droppings, laboratory waste, shop waste, kitchen waste, etc. and more particuarly to such a system configured generally in the form of a glove or glove-like device.

Prior art waste disposal systems, for example, for disposing of animal droppings, such as dog, cat or other pet droppings are generally bulky and relatively complicated to make or use. The alternative to the prior art waste disposal devices is to merely use a rag or newspaper to scoop up the waste, thereby leading to possible contact with the waste material and/or soiling of the clothing of the person picking up the waste material. Moreover, when using a rag or newspaper to scoop up waste, this exposes the user to unpleasant smells and unpleasant feel and temperature of the waste being disposed of.

An object of the present invention is to provide a simple, inexpensive, portable, pleasant, highly reliable, easy to use waste disposable system for disposing of animal droppings and other wastes.

Another object of the invention is to provide a simple, inexpensive waste disposal system which permits disposing of waste such as animal droppings, while preventing personal contact with the waste, thereby preventing the spreading of germs or odors, and which substantially completely encloses the droppings after they are picked up.

SUMMARY OF THE INVENTION

According to the invention, a glove-like waste disposal system comprises a flexible inner glove member which is placed over the hand of a user; and a flexible outer glove member which is placed over the inner glove member. The outer glove member is made of a thin, flexible disposable material, and the inner glove member is made of a material which is relatively thick as compared to the material of said outer glove member. After picking up of waste, the outer glove member is removed or stripped off of the inner glove member to an inside-out pouch forming configuration which contains the picked-up waste material in the pouch formed therein.

Preferably, the inner glove member is made of a heat insulating material and is sufficiently thick to prevent the user from feeling the waste material as it is picked up. The inner glove member is preferably reusable. In a further preferred embodiment, the outer glove comprises at least one moisture absorbant layer on at least the palm or outer surface thereof.

A method of using the glove-like waste disposal system comprises placing the inner glove member over the hand of a user; placing the outer glove member over the inner glove; picking up waste with the fingers of the user through the glove members; and then turning the outer glove-like member to an inside-out, pouch-forming position, whereby the waste picked up by the user is retained inside the pouch formed by turning the outer glove member inside-out. The inside-out outer glove member is then disposed of.

DETAILED DESCRIPTION

Figure 1:
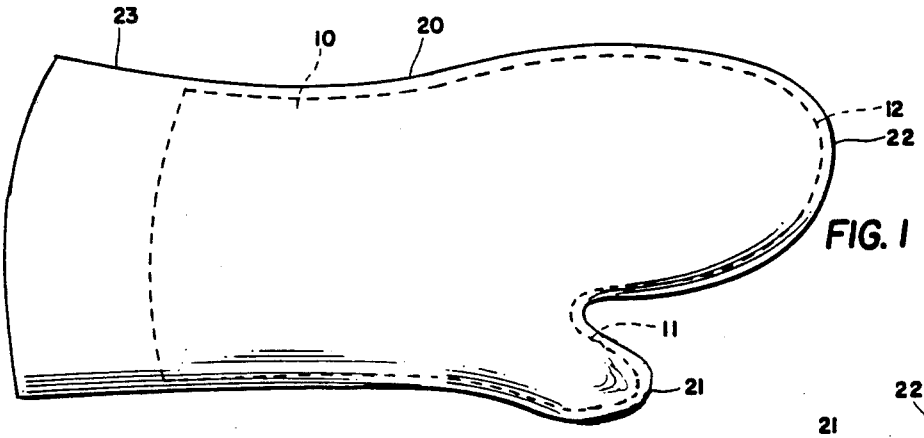
FIG. 1 is a plan view of a typical glove-like waste disposal device of the invention.

Referring to FIG. 1, a waste disposal device of the present invention comprises an inner glove-like member 10 of given length and into which the user places his hand. Throughout the present specification, the inner glove-like member 10 will be referred to as "inner glove 10".

An outer glove-like member 20 is placed over the inner glove 10, as shown in FIG. 1. Hereinafter, the outer glove-like member 20 is referred to as "outer glove 20". Preferably, the outer glove 20 is shaped generally like a mitten and comprises a finger portion 21 for receiving the thumb of the user, and an enlarged portion 22 for receiving the other four fingers of the user. The outer glove 20 has an elongated cuff portion 23 which extends past the end of the inner glove 10 and over the arm portion of the user to provide more protection to the user during use. It is not necessary for the inner glove 10 to have such a long cuff, as will become apparent from the following discussion.

The inner glove 10 is also preferably "mitten-shaped" and preferably has a thumb portion 11 and an enlarged finger portion 12 for receiving the other four fingers of the hand of the user. The inner glove 10 is preferably made of a relatively thick, insulating material, which is also flexible. The inner glove 10 can be made of, for example, cellulose, plastic foam, styrofoam, wool, flexible plastic, rubber or other flexible insulating materials. The outer glove 20 is a disposable glove made of thin, flexible, strong, waterproof material, for example, the materials from which plastic storage bags are made. Typical film materials for the outer glove 20 are polyolefins (such as polyethylene, polypropylene, etc.), polyvinyl chloride, polyvinylidine, linear low density polyethylene and other linear plastics.

Figure 2:
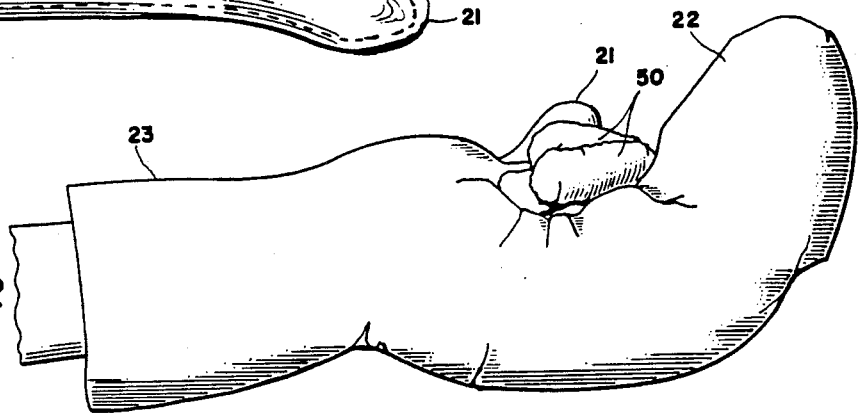
FIG. 2 shows the device of FIG. 1 in use.
Figure 3:
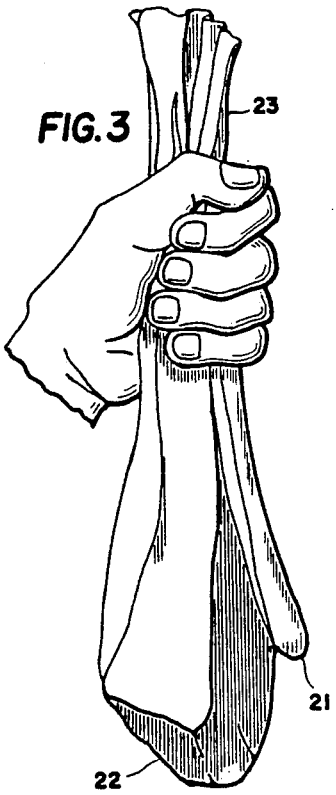
FIG. 3 shows the outer glove turned inside-out, with the waste material contained therein.

The outer glove 20 is preferably oversized (i.e., larger than inner glove 10) so that it can be easily installed over the inner glove to achieve the configuration shown in FIG. 1. If the user is wearing a long-sleeved coat, jacket, shirt or the like, the sleeves can be tucked into the oversized cuff portion 23 of the outer glove to protect them from soiling. In use, the user bends his fingers so that the palm portion of the glove-like waste disposal device forms a "pouch" in the palm of the hand, as shown in FIG. 2. Then, the user merely picks up the waste material with his fingers so that the waste material is in the pouch formed in the palm of his hand. FIG. 2 shows the device with waste 50 in the palm of the hand. Next, the outer glove is removed by being stripped off and turned inside-out as it is removed, so that the waste material 50 ends up inside a pouch formed by the inside-out outer glove, fully enclosed and protected by the inside-out outer glove 20, as seen in FIG. 3.

The inner glove 10 is untouched by the waste material 50 and is retained for re-use. If any material does happen to contact the inner glove 10, or if the inner glove 10 becomes dirty from other sources of dirt, it can be cleaned and reused.

The outer glove 20 may be clear, opaque or colored. Preferably, it is opaque or colored (non-transparent) so that after the outer glove 20 is turned inside-out, the user cannot see the waste material contained therein. The inner glove 10 is relatively thick (preferably about 1/16 to ¼ inches thick) so as to insulate the user against the temperature and "feel" of the waste material picked up by the user. Also, the thick inner insulating glove 10 is preferably lightly scented in order to make it more pleasant for use, and could also contain a deodorant.

Figure 4:
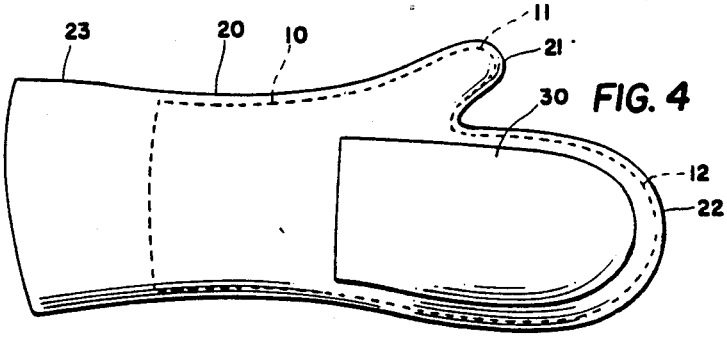
FIG. 4 shows a modified embodiment of the device of FIG. 1, with liquid absorbant layers attached thereto.

As shown in FIG. 4, an absorbant layer, such as absorbant paper 30, may be attached to the palm-side of the outer glove 20 to absorb moisture in the waste material picked up. Still further, another absorbant layer such as the paper layer 30, may be attached to the rear side (back of hand side) of the outer glove 20, (not shown, but exactly like paper layer 30 of FIG. 4), and which can be used by the user to wipe the surface from which the waste is picked up. After the outer glove 20 is turned inside-out, the absorbant layers 30 are inside of the glove and cannot contact the exterior. At this time, the absorbant layers 30 will function to absorb moisture in the waste material which it contacts inside the pouch formed by turning the outer glove 20 inside-out (FIG. 3). One or both layers 30 can be provided as desired, and can be adhesively connected to the outer glove 20.

After turning the outer glove 20 inside-out to contain the waste material therein, as shown in FIG. 3, the outer glove 20 can be disposed of. However, before disposal, the user may wish to either tie the end (cuff portion 23) of the outer glove 20 in a knot so as to more effectively seal the waste therein, or may close the cuff end 23 of the outer glove 20 by using a flexible metal or plastic "tie" or the like, which are conventionally used for closing plastic bags.

Figure 5:
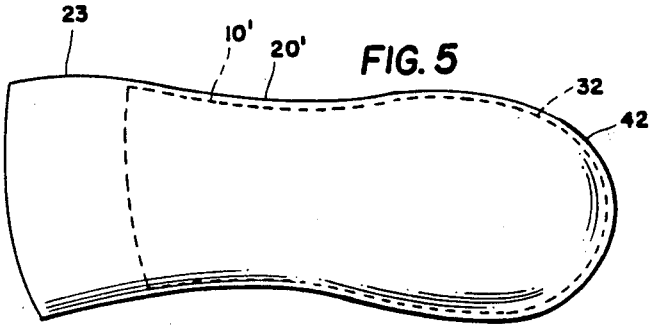
FIG. 5 is a modified embodiment of the device of FIG. 1.

FIG. 5 shows a modified embodiment wherein the inner and outer gloves 10',20', respectively are formed without thumb receiving portions. In this embodiment, the finger ends of inner and outer gloves are formed as "pouches" 32,42 for receiving all of the fingers of the user. Operation of the device of FIG. 5 is exactly the same as described above with respect to FIGS. 1–4 and the inner and outer gloves are fabricated of the same materials as described above with respect to FIGS. 1–4. Moreover, absorbant layers 30 can be provided in the inner (palm) and/or outer (back of hand) sides of the glove, to absorb moisture, as described above.

Figure 6:
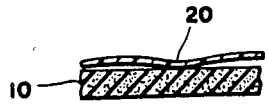
FIG. 6 is a partial cross-section showing the relationship between the inner and outer glove-like members.

FIG. 6 is a partial cross-sectional view showing the relationship between the materials of inner glove 10 and outer glove 20. As can be seen, inner glove 10 is relatively thick, whereas outer glove 20 is relatively thin. The cross section of FIG. 6 also shows that the outer glove 20 is loosely fitted over the inner glove 10 to facilitate using the device.

To use the device of the present invention as a consumer item, several outer gloves will be packaged with each inner glove, since the inner glove is reusable, while the outer gloves are disposed of after one use. This provides a highly economical system for disposal of waste, such as animal droppings.

What is claimed is:

1. A glove-like waste material disposal system comprising:

a flexible inner glove member which is placed over the hand of a user; and a separate flexible outer glove member which is placed over the inner glove member;

said outer glove member completely enclosing said hand except for the hand opening therein and being made of a thin, flexible, disposable material, and said inner glove member having at least its finger and palm covering portions made of a material which is relatively thick as compared to the material of said outer glove member and of a sufficient thickness to prevent the user from substantially feeling the waste material as it is picked up with a required finger pressure;

whereby after picking up of waste, said outer glove member is removed or stripped off of the inner glove member to an inside-out pouch forming configuration which contains the picked-up waste material in the pouch formed therein.

2. The glove-like waste disposal system of claim 1, wherein said inner glove member is made of a heat-insulating material.

3. The glove-like waste disposal system of claim 1, wherein said inner glove member is made of a heat-insulating material.

4. The glove-like waste disposal system of claim 1, wherein said outer glove member comprises at least one moisture absorbant layer on at least one surface thereof.

5. The glove-like waste disposal system of claim 4, wherein said moisture absorbant layer is attached to the inner or palm side of said outer glove member.

6. The glove-like waste disposal system of claim 1, wherein at least said inner glove member carries a deodorant material.

7. The glove-like waste disposal system of claim 1, wherein at least said inner glove member carries a scent emitting material.

8. The glove-like waste disposal system of claim 1, wherein said outer glove member has a cuff portion which is substantially longer than a cuff portion of said inner glove member.

9. The glove-like waste disposal system of claim 1, wherein said outer and inner glove members comprise a thumb receiving portion and a pouch-like portion for receiving the other four fingers of a user.

10. The glove-like waste disposal system of claim 1, wherein said inner and outer glove members comprise a single pouch for receiving all of the fingers of a user.

11. The glove-like waste disposal system of claim 1, wherein said outer glove member is made of polyethylene.

12. The glove-like waste disposal system of claim 11, wherein said inner glove member is made of a foam-type material.

13. The glove-like waste disposal system of claim 1, wherein said inner glove member is made of a foam-type material.

14. The glove-like waste disposal system of claim 1, wherein said outer glove member is opaque.

15. A method of waste disposal using the system of claim 1, comprising:

placing said inner glove member over the hand of a user;

placing said outer glove member over said inner glove member;

then picking up waste with the fingers of the user through said glove members;

turning said outer glove member to an inside-out, pouch-forming position, whereby the waste picked up by said user is retained inside said pouch formed by turning said outer glove member inside-out; and disposing of said inside-out outer glove member.

16. The method of claim 15, comprising tying closed the open end of said inside-out outer glove member.

17. The glove-like waste disposal system of claim 1, wherein said outer glove member comprises a film selected from the group consisting of polyethylene, polypropylene, polyvinyl chloride, polyvinylidine and linear low density polyethylene.

18. The glove-like waste disposal system of claim 1, wherein said outer glove member comprises a polyolefin film.

19. A glove-like waste material disposal system comprising:

a flexible inner glove means which is placed over the hand of a user; and a separate flexible outer glove which is placed over the inner glove means;

said outer glove completely enclosing said hand except for a hand opening therein and being made of a thin, flexible, disposable material, and said inner glove means having relatively thick finger and palm covering portions for preventing the user from feeling the waste material as it is picked up with a required finger pressure.

* * * * *